US007982118B1

(12) United States Patent
Gleaves et al.

(10) Patent No.: US 7,982,118 B1
(45) Date of Patent: Jul. 19, 2011

(54) MUSICAL DATA INPUT

(75) Inventors: Durin Gleaves, Seattle, WA (US); Daniel Ramirez, Seattle, WA (US); Chris Robinson, Mill Creek, WA (US)

(73) Assignee: Adobe Systems Incorporated, San Jose, CA (US)

( * ) Notice: Subject to any disclaimer, the term of this patent is extended or adjusted under 35 U.S.C. 154(b) by 0 days.

(21) Appl. No.: 11/923,562

(22) Filed: Oct. 24, 2007

Related U.S. Application Data

(60) Provisional application No. 60/970,528, filed on Sep. 6, 2007.

(51) Int. Cl.
*G10H 7/00* (2006.01)

(52) U.S. Cl. ..... 84/609; 84/645; 84/649

(58) Field of Classification Search ..... 84/609, 84/645, 649

See application file for complete search history.

(56) References Cited

U.S. PATENT DOCUMENTS

| | | | | | |
|---|---|---|---|---|---|
| 3,986,422 | A * | 10/1976 | Coles | 84/678 |
| 5,129,303 | A * | 7/1992 | Coles | 84/685 |
| 5,430,244 | A * | 7/1995 | Ruffcorn et al. | 84/669 |
| 5,495,786 | A * | 3/1996 | Choi | 84/470 R |
| 5,501,130 | A * | 3/1996 | Gannon et al. | 84/454 |
| 5,502,274 | A * | 3/1996 | Hotz | 84/613 |
| 5,841,053 | A * | 11/1998 | Johnson et al. | 84/615 |
| 6,175,069 | B1 * | 1/2001 | Longacre | 84/476 |
| 6,204,441 | B1 * | 3/2001 | Asahi et al. | 84/470 R |
| 6,327,367 | B1 * | 12/2001 | Vercoe et al. | 381/61 |
| 6,372,973 | B1 * | 4/2002 | Schneider | 84/609 |
| 6,388,181 | B2 * | 5/2002 | Moe | 84/477 R |
| 6,448,486 | B1 * | 9/2002 | Shinsky | 84/613 |
| 7,053,291 | B1 * | 5/2006 | Villa | 84/609 |
| 2003/0110924 | A1 * | 6/2003 | Miyamoto | 84/477 R |
| 2003/0117400 | A1 * | 6/2003 | Steinberg et al. | 345/440 |
| 2006/0027080 | A1 * | 2/2006 | Schultz | 84/613 |
| 2006/0037458 | A1 * | 2/2006 | Guinness | 84/100 |
| 2008/0236366 | A1 * | 10/2008 | Van Os et al. | 84/609 |

* cited by examiner

*Primary Examiner* — Walter Benson
*Assistant Examiner* — Kawing Chan
(74) *Attorney, Agent, or Firm* — Fish & Richardson P.C.

(57) ABSTRACT

Methods, systems, and apparatus, including computer program products, for entering or editing musical note data. In one aspect, a method includes receiving a user input selecting a scale; receiving a user input of notes; determining whether each note is in the scale; and for each note that is not, automatically replacing the note with a corrected note. In another aspect, a method includes displaying a segment of music; receiving user input selecting a scale, multiple notes from the displayed music, and a pitch displacement; displacing the notes; and for each displaced note that is not in the scale, automatically replacing the displaced note with a corrected note. In another aspect, a method includes receiving user inputs selecting multiple scales and a non-overlapping period of time for each scale; receiving notes, each for a particular period; and correcting the notes as necessary according to the scale for the period.

27 Claims, 7 Drawing Sheets

MUSICAL DATA INPUT

CROSS-REFERENCE TO RELATED APPLICATION

This application claims priority to pending U.S. Provisional Application Ser. No. 60/970,528, filed Sep. 6, 2007, the entire contents of which are hereby incorporated by reference.

BACKGROUND

This specification relates to the input or editing of musical data.

Digital audio data can include audio data in different digital audio tracks. Tracks are typically distinct audio files. Tracks can be generated mechanically (e.g., using a software application to enter individual notes on a visual representation of a musical instrument), or synthesized. A user can use, for example, a digital keyboard, a MIDI sequencer, a synthesizer, or a digital sampler as an input device. Audio data can represent musical sounds (e.g., notes on a piano).

Audio data can be displayed in various visual representations. For example, a piano roll editor (or MIDI key editor), shows a representation of musical notes (e.g., highlighted boxes) in the time-domain (e.g., a graphical display with time on the x-axis and piano keyboard octave indications on the y-axis). Musical notes are graphically represented in the piano roll editor as they are entered by the user or the system (e.g., using a MIDI instrument, a keyboard, a mouse, a microphone, or any other peripheral device for entering musical data). Tracks can be played and analyzed alone or in combination with other tracks. Additionally, audio data would require correction when the notes are entered incorrectly by the user.

SUMMARY

The subject matter described in this specification can be implemented to provide methods, systems, and apparatus operable to adjust music data input according to a selected key and type of scale to yield musical composition data that in general is harmonically pleasing and consistent.

Particular embodiments of the subject matter described in this specification can be implemented so as to realize one or more of the following advantages. Notes entered into the system, e.g., as incoming MIDI note data, are automatically adjusted to conform to a specified key and scale. Adjusting note data input to a specified key and scale allows a novice composer to create music without extensive knowledge of music theory (e.g., keys and scales). The automatic adjustment of note data to conform to an unfamiliar specified key and scale (e.g., D Major), designated for a certain period of time (e.g., four measures), allows a novice musician to play in a familiar key (e.g., C) and kind of scale (e.g., Major), while the system automatically adjusts the incoming MIDI note data into the non-familiar key. Additionally, MIDI note data may be automatically adjusted (e.g., transposed), between both scales and keys, allowing the user to switch a composition in a major key into a composition in a minor key. The automatic adjustment between scales and keys can be used to create consistent harmonic transpositions. Additional adjustments to the composition may be made manually after any automatic adjustments have taken place, allowing the user the freedom to create harmonically pleasing musical compositions. Music input by a user can be constrained to be in a selected key and kind of scale while maintaining the rhythmic features of the music.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
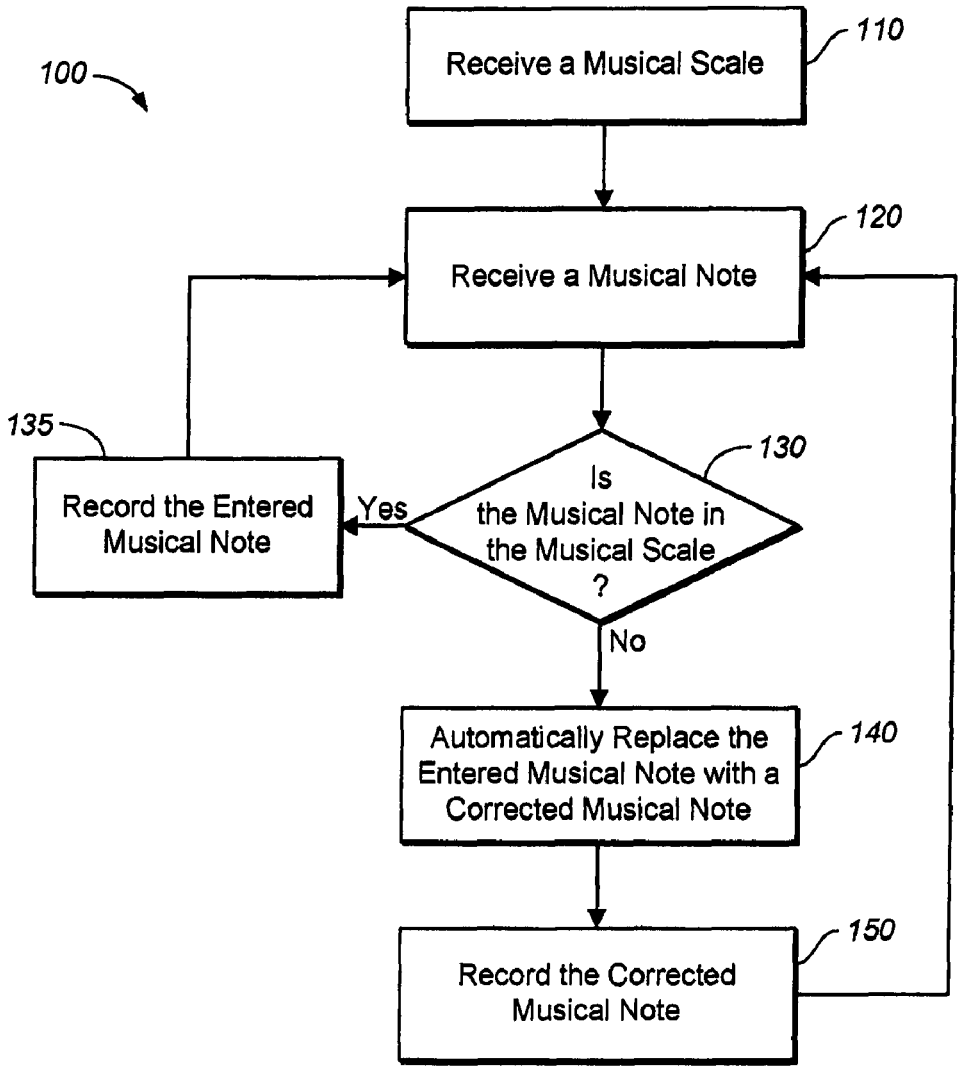
FIG. 1 shows an example method for adjusting a musical note.

FIG. 1 shows an example method 100 for adjusting a musical note. For convenience, the method 100 will be described with reference to a system that performs the method 100. The system (e.g., a computer, an application and a musical keyboard), receives 110 a selection of a musical scale from a user (e.g., using a user interface or a musical keyboard). In some implementations, the system receives the selection of more that one the musical scale from a user, which will be described in greater detail below with reference to FIG. 3.

A musical scale is a series of single notes progressing up or down stepwise, where the first note and the last note (the primary notes) are similar notes separated by an ordered series of musical intervals (e.g., an octave, or twelve semi-tones), which, along with the key or tonic, define the pitches. The smallest distance (or interval) between two notes in a scale is the semi-tome (or half-step). An interval consisting of two semi-tones is equivalent to a whole tone (or whole step).

The distances between each pair of notes in a scale is predetermined based on both the key and the type of scale being used. The key is the implied adherence, in any passage, to the note-material of any given type of scale, (e.g., major, minor, pentatonic, etc.) where one note is recognized as the controlling note, key-note, or tonic. Thus, a note is "in-scale" when the note is in a selected key (e.g., C) and a selected type of scale (e.g., Major). Some keys and types of scales are easier to remember and adhere to based on the number of accidentals (i.e., sharps and flats) that are in the key signature. For example, in the key of C Major, there are no sharps (e.g., notes which have to be adjusted up a semi-tone) or flats (e.g., notes which have to be adjusted down a semi-tone). In C Major, C is tonic, and the "in-scale" musical notes in a C Major scale are C, D, E, F, G, A, B, C, where the intervals (/=semi-tone and /\=whole-tone) between the notes are C/\D/\E/F/\G/\A/\B/C. In contrast, the "in-scale" musical notes in a c natural minor scale include three flat notes. The in-scale musical notes in a c natural minor scale are C, D, Eb, F, G, Ab, Bb, C, where the intervals between the notes are C/\D/Eb/\F/\G/Ab/\B/\C.

In addition to receiving 110 a selection of a musical scale (e.g., a selection of both a key and a type of scale), the system additionally receives 120 a selection of one or more musical notes from a universe of musical notes (e.g., any musical note pitches capable of being created in any way). In some implementations, the selection of musical notes is entered in real-time (e.g., as they are played) using a MIDI (Musical Instrument Data Interface) enabled electronic instrument. In other implementations, the user may enter musical notes using a graphic interface or on-screen virtual piano keyboard (e.g., a MIDI key editor or piano roll editor) like the one shown in FIG. 2.

Figure 2:
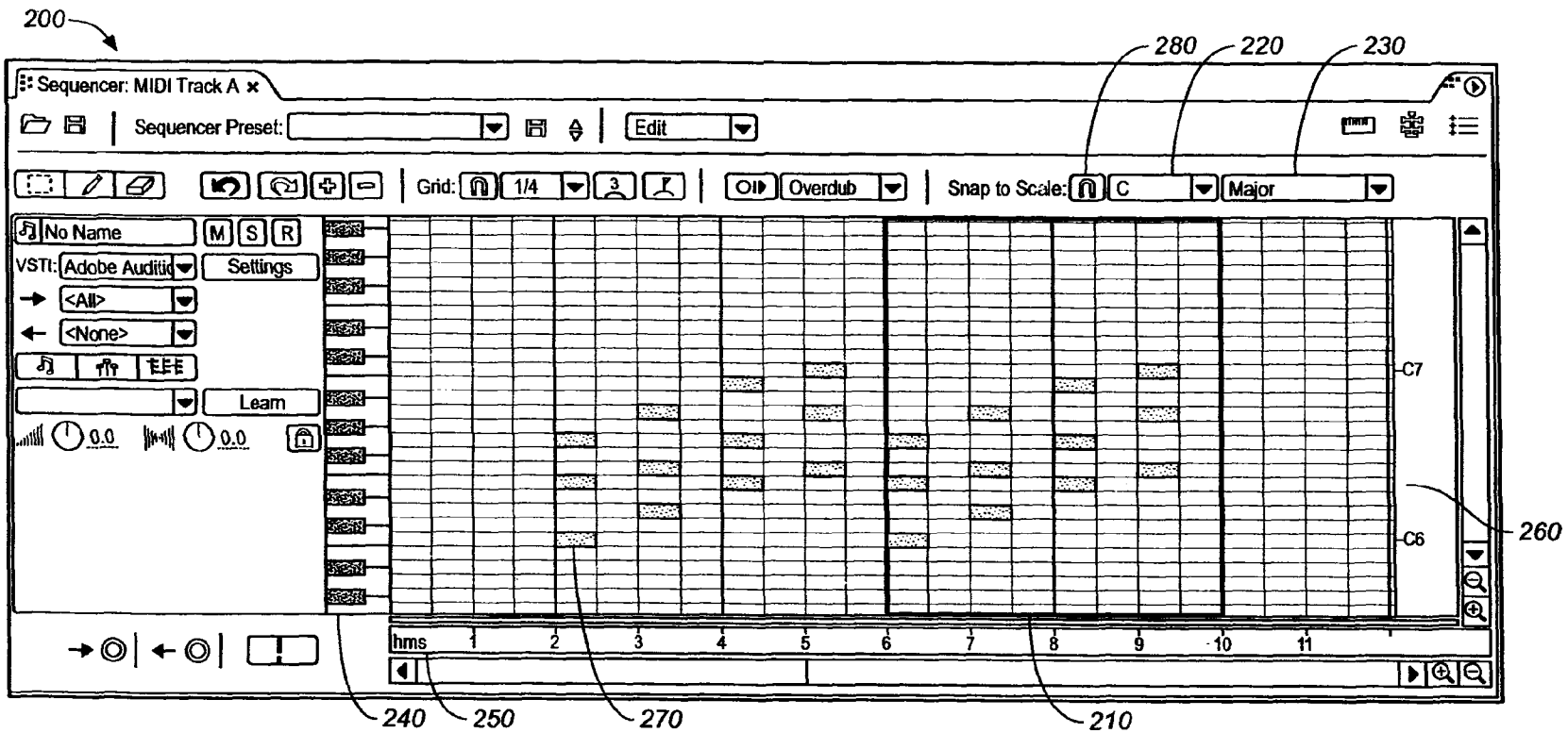
FIG. 2 shows an example display of a MIDI key editor, where a group of musical notes has been selected for adjusting to a new scale.

FIG. 2 shows an example display 200 of a MIDI key editor, where a group of musical notes 210 has been selected for adjustment to a new scale. FIG. 2 includes a key indication 220, a type of scale indication 230, and a musical keyboard representation 240 for determining the pitches of the musical notes 210. FIG. 2 includes an indication of time 250 (e.g., in seconds or in beats) on the y-axis and placement 260 (e.g., octave) on the x-axis. Each note 270 is entered into the system for a particular time and based on a particular selected key and type of scale. For example, in FIG. 2, the selected key 220 is C and the selected type of scale 230 is Major. After a note 270 is entered into the system, a determination 130 is made as to whether the note 270 is in the selected musical key 220 and type of scale 230. If the note 270 is valid, i.e., in the selected musical key 220 and type of scale 230 (which will be referred to as being "in-scale"), the system records 135 the note 270 (e.g., in RAM or in a digital audio data file). If the note 270 is not in-scale, the system automatically replaces 140 the note 270 with a corrected note that is in-scale.

The correction of notes occurs automatically 140 when the user enables a "snap to scale" 280 feature. Snap to scale 280, when enabled, compares each note 270 to the selected key 220 and type of scale 230 to determine if the musical note is in the selected key 220 and type of scale 230. If not, the note 270 is adjusted to a nearest in-scale note. In the event two correct musical notes are an equivalent distance (interval) from the entered musical note, the higher note is selected as the correct musical note. In some implementations, the lower note is selected. In some implementations, whether to select the higher or lower note is a configuration or user-selectable option.

Once the entered musical note 270 has been replaced by the correct musical note, the correct musical note is recorded 150 (e.g., for subsequent playback).

The graphic representation of each musical note has corresponding audio musical data, and changes to the graphic representation of the musical note automatically changes the corresponding audio musical data accordingly.

Figure 3:
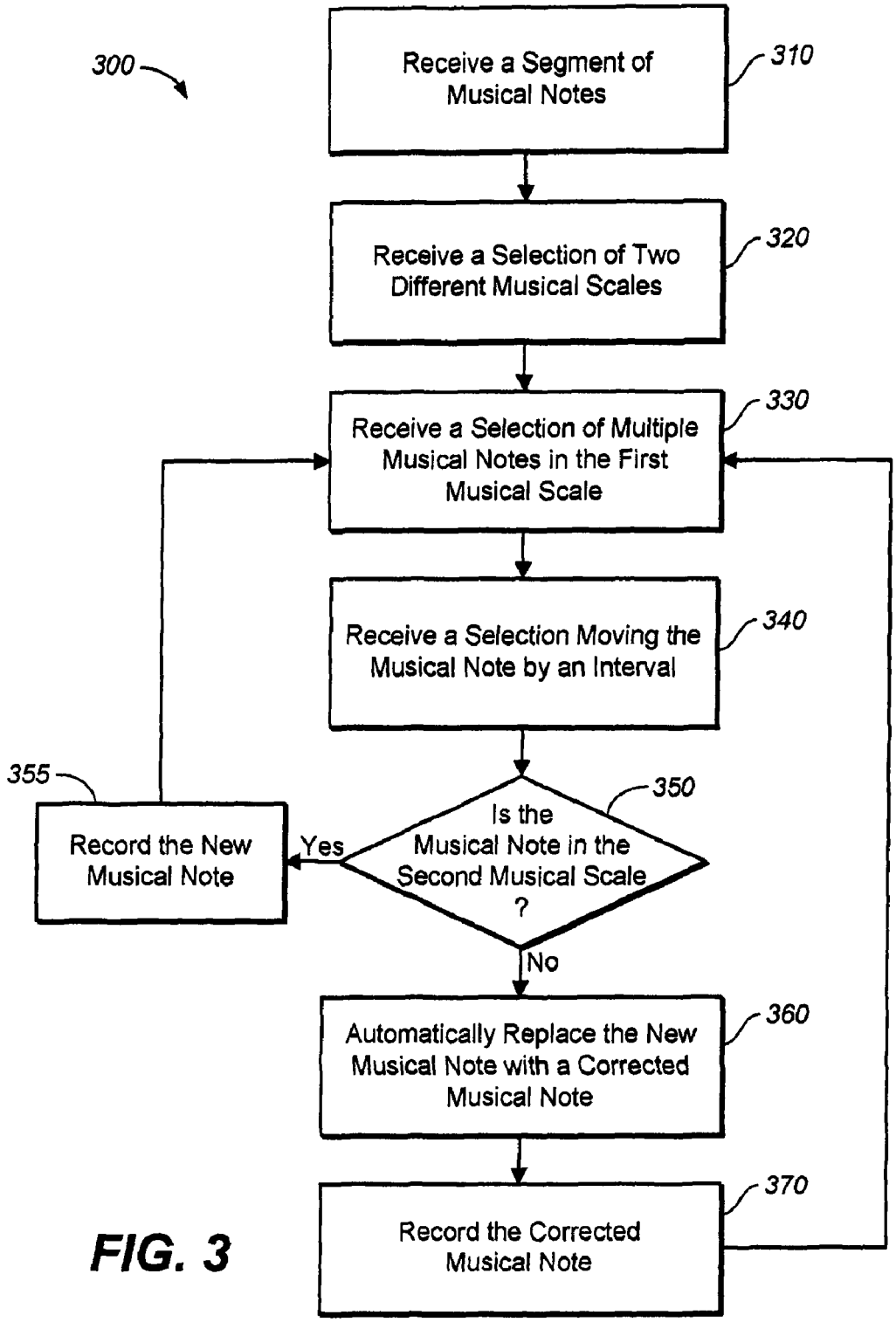
FIG. 3 shows an example method for automatically adjusting a moved selection of musical notes.

FIG. 3 shows an example method 300 for automatically adjusting a moved selection of musical notes.

Figure 4:
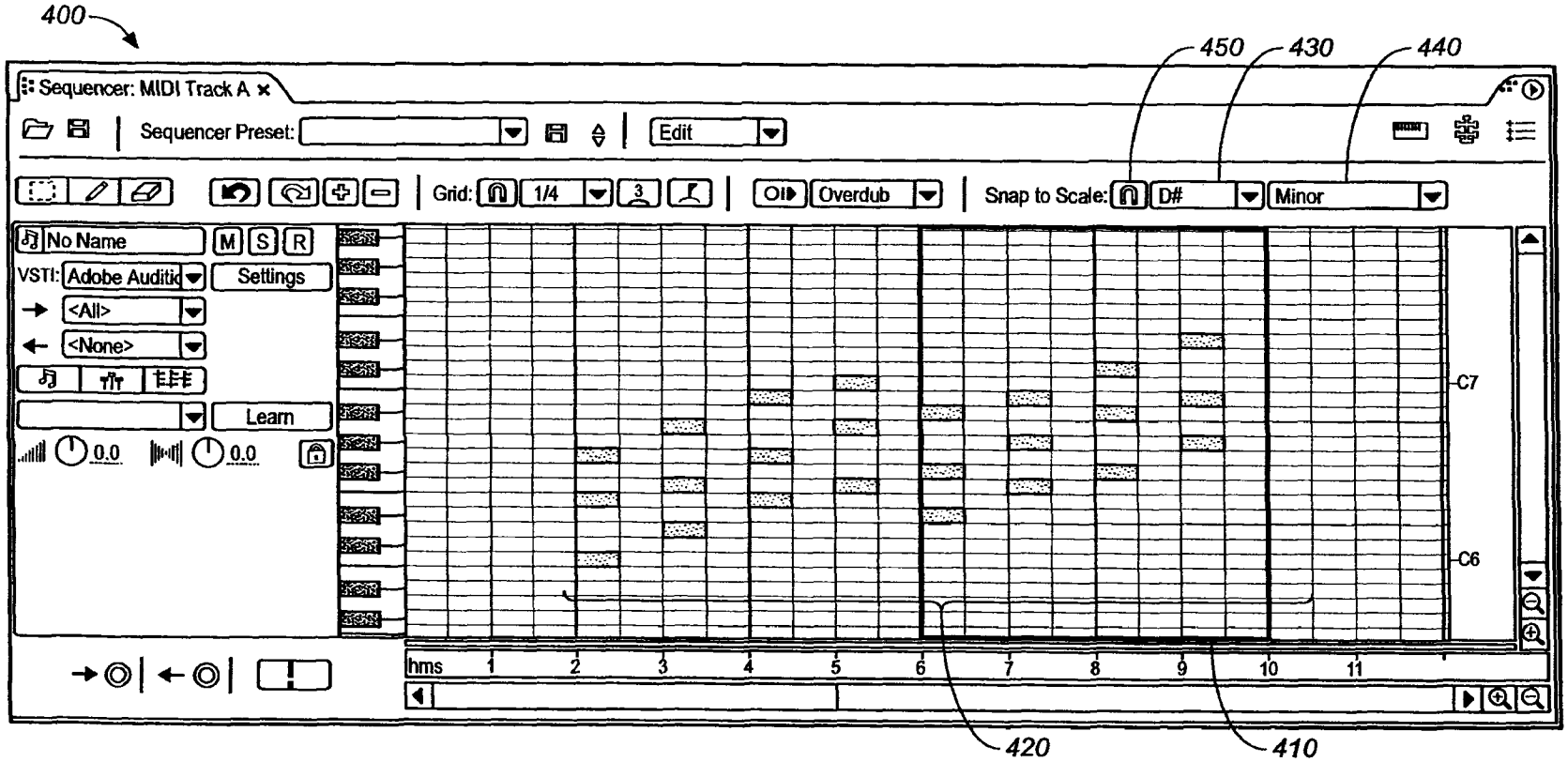
FIG. 4 shows an example display of the selected musical notes from FIG. 2 adjusted to a new scale.

FIG. 4 shows an example display 400 of a MIDI key editor, where the group of musical notes 210 has been corrected from the values of an old key 220 and type of scale 230 to the values of a selected new key 430 and type of scale 440. As noted above, in FIG. 2, a group (or segment) of musical notes 210 is received 310 in a first selected 320 key (e.g., C) and type of scale (e.g., Major). The system receives 330 a selection (e.g., through the use of any graphic selection tool) of one or more musical notes 210 for adjustment 340 by a pitch displacement of a user-selected interval distance. The displaced notes will be corrected according to a new selected 320 key 430 (e.g., D#) and type of scale 440 (e.g., minor). The system allows the selected interval distance the one or more musical notes are moved 420 to be independent of the interval distance between the any original key and type of scale and the selected new key and type of scales (e.g., the interval distance between the primary notes or any other notes in the two scales).

In some implementations, the interval distance a note will be moved is selected first, and then the note is compared to the selected key and type of scale to determine 350 if a correction is necessary. For example, the tonic note of the selected group of notes in the first key and Major scale may be moved to the tonic note of the second key and Major scale, thus preserving the melody as a straight transposition. Additionally, the tonic note of the selected group of notes in the first key and Major scale may be moved to the tonic note of the second key and minor scale, creating an alternative and minor version of the original melody. Additionally, the tonic note of the selected group of notes in the first key and Major scale may be move to any note in the second key and scale, possibly creating a completely distorted (and perhaps unrecognizable version) of the original melody. By this method, complete melodies may be changed (e.g., for use as an alternative dissonant melody in the scary part of a video game).

With the snap to scale function enabled, e.g., by selecting icon 450, for each selected musical note 210, the move defines a new note 410. If the new note is valid for the selected musical key 430 and type of scale 440, the system records 355 the new note. If not, the new note is automatically corrected 360 to a nearest valid note as described above, and recorded 370 (e.g., for subsequent playback).

Figure 5:
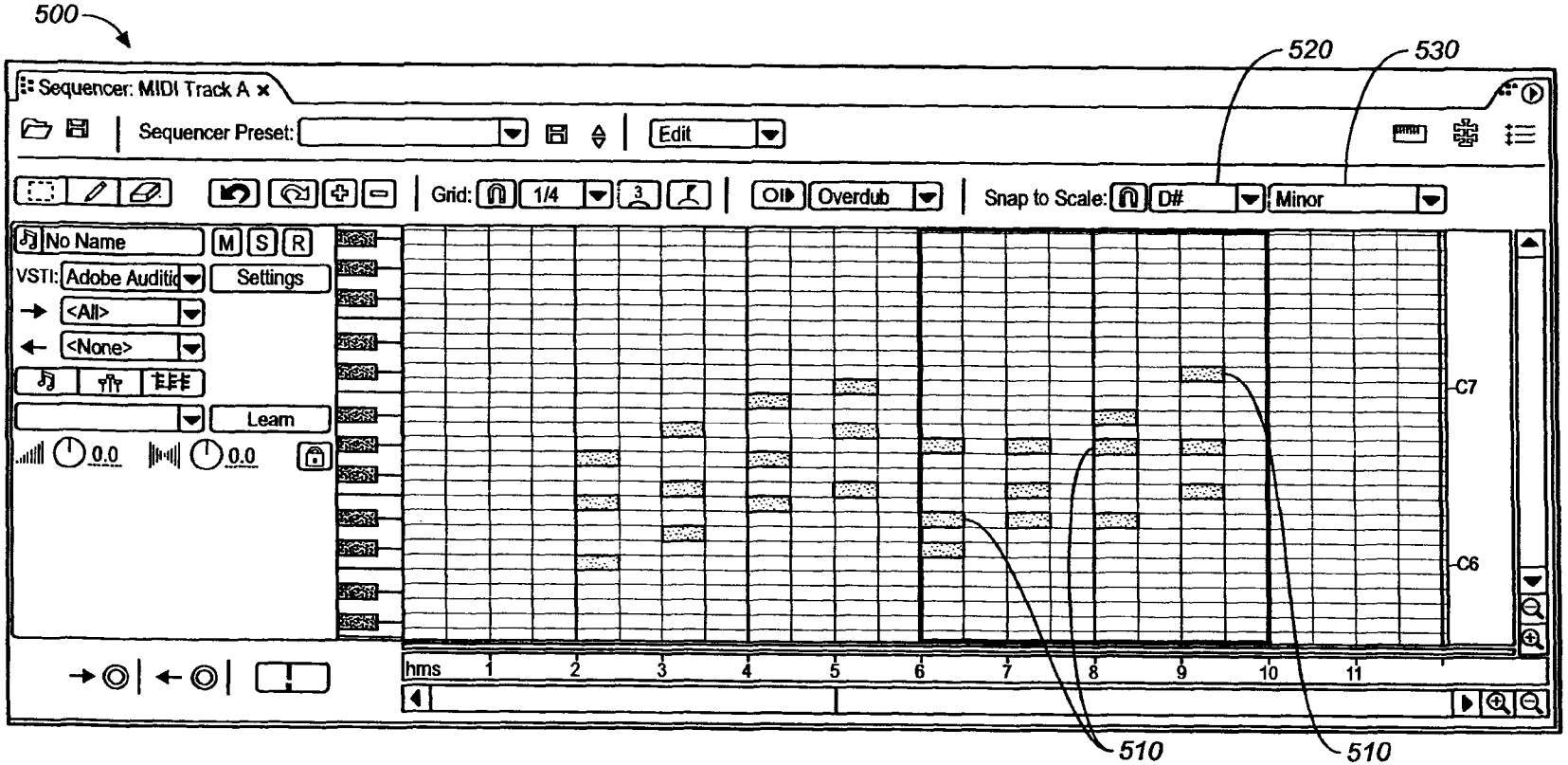
FIG. 5 shows an example display of additional manual adjustments to the corrected musical notes from FIG. 4.

FIG. 5 shows an example display 500 of manual adjustments to musical notes 510. The user has disabled the snap to scale feature. The displacement of musical notes 510 that the user manually selects can be independent of the notes the user initially chooses to change in the selected scale (e.g., key 520 and type of scale 530). Additionally, in some implementations, even when the snap to scale feature is enabled, the system will not automatically correct portions of musical data that are not in-scale without a user selection of notes for correction. In some implementations, the system can identify by highlighting or otherwise notes that are not in-scale with reference to a user-selected scale.

Figure 6:
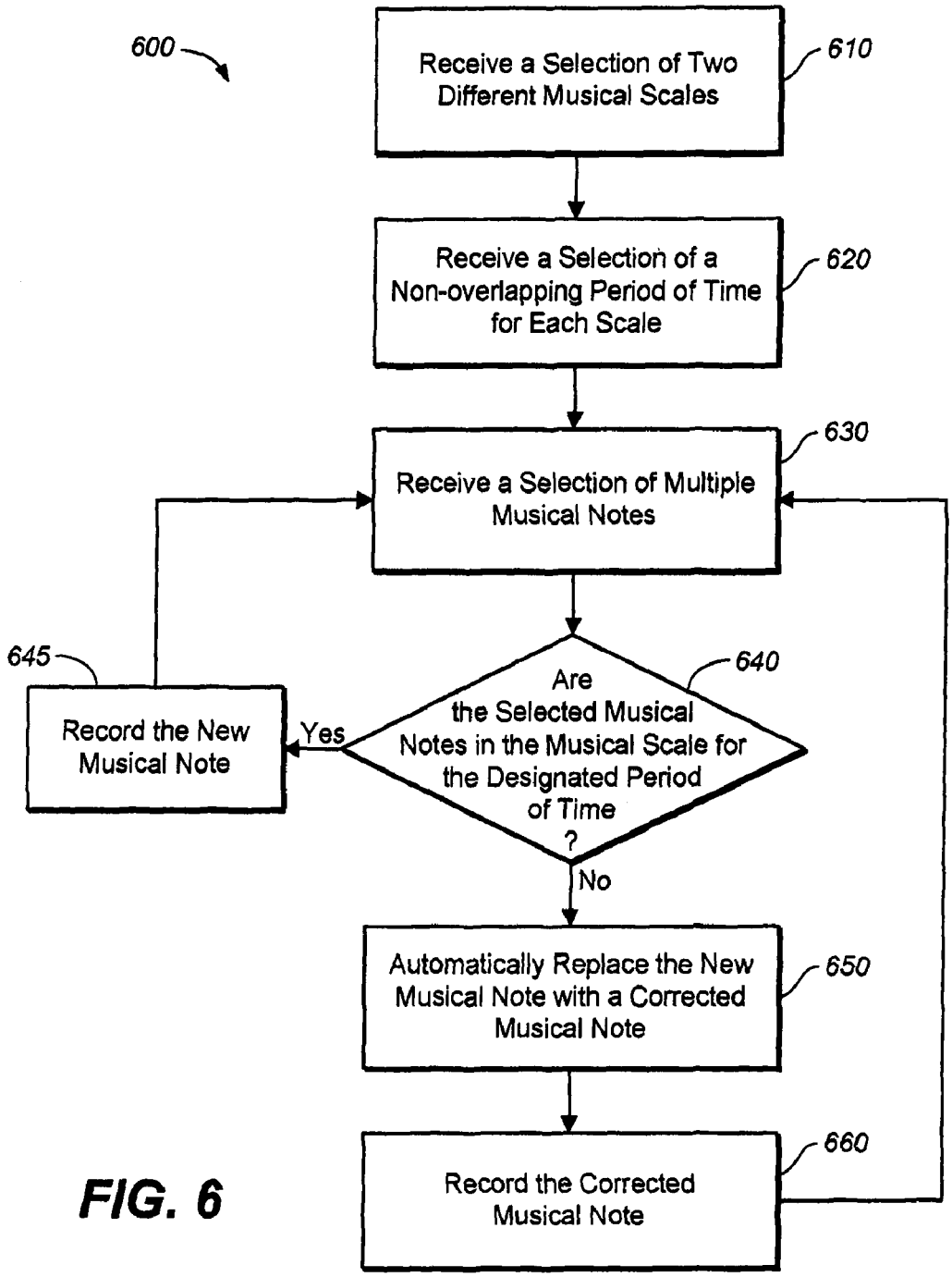
FIG. 6 shows an example method for automatically adjusting a selection of musical notes between a selection of musical scales, where each musical scale is designated for a non-overlapping period of time.
Figure 7:
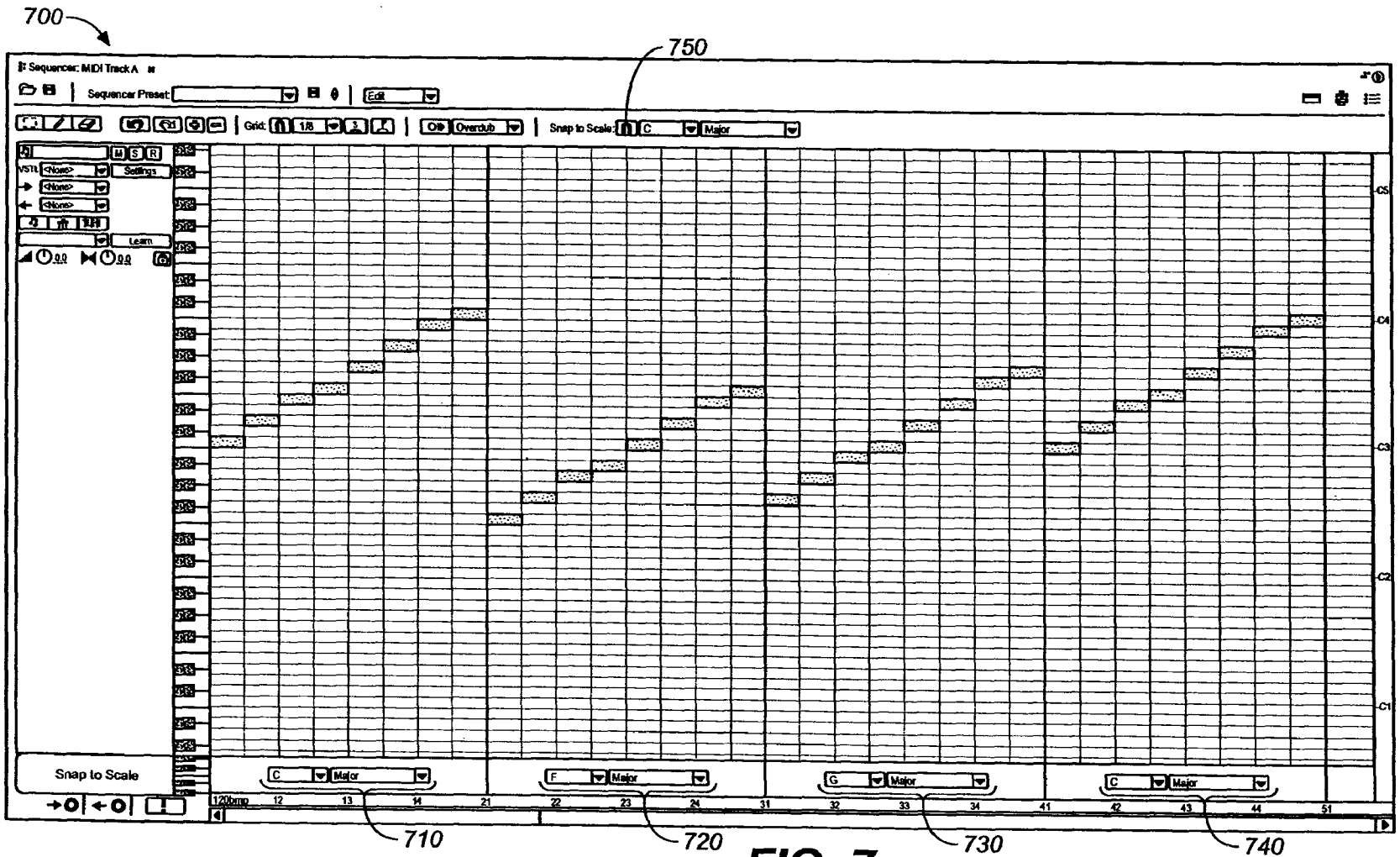
FIG. 7 shows four different selected keys and scales, where each key and scale is designated for a certain time period, and where notes entered during that time period are in that designated key and scale.

FIG. 6 shows an example method 600 for automatically adjusting a selection of musical notes between a selection of musical scales, where each musical scale is designated for a non-overlapping period of time. FIG. 7 shows an example display 700 of a MIDI key editor, where a group of musical notes is corrected according to the selected values of a given key and type of scale in use at the time in or for which the musical notes are entered. The system receives 610 a selection of two or more scales (i.e., two or more keys and types of scales 710-740). Each scale is selected 620 for a designated non-overlapping period of time in which that scale will be used to correct the notes entered during or for that time period. In some implementations, a non-overlapping period of time can be one or more musical beats where the sixty fourth note is the smallest note value that can be worth one musical beat.

With the snap to scale function enabled, e.g., by selecting icon 750, as the musical notes are selected 630 or entered (e.g., on a piano keyboard or other device), the entered musical notes automatically become corrected musical notes according to the designated key and type of scale 710-740 for the time period in or for which the musical notes were entered, as described above, the system compares each musical note as it is entered, to the key and type of scale 710-740 for that time period to determine 640 if the value of the musical note is valid or correct (e.g., conforms to the selected key and type of scale 710-740 parameters). If the entered musical note is in-scale (e.g., conforms to the selected key and type of scale 710-740 parameters), the system records 645 the musical note. If not, the musical note is automatically corrected 650 to (or replaced by) a nearest in-scale note in the manner described above. Once the moved musical note has been replaced by the corrected musical note, the corrected musical note is recorded 660 (e.g., for subsequent playback).

Thus, in some implementations, a user could enter musical notes into a musical keyboard in a simple scale (e.g., C Major), and the entered musical notes would automatically be adjusted according to the selected scale (e.g., F Major) without any additional user input or knowledge of music theory. Additionally, any incorrect (non-harmonic) note entered by a user would be automatically adjusted to a correct (harmonic) note without requiring any further user interaction with the system. Thus, the user would be able to have a completely harmonically correct recording of every performance.

Embodiments of the subject matter and the functional operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a tangible program carrier for execution by, or to control the operation of, data processing apparatus. The tangible program carrier can be a propagated signal or a computer-readable medium. The propagated signal is an artificially generated signal, e.g., a machine-generated electrical, optical, or electromagnetic signal, that is generated to encode information for transmission to suitable receiver apparatus for execution by a computer. The computer-readable medium can be a machine-readable storage device, a machine-readable storage substrate, a memory device, a composition of matter effecting a machine-readable propagated signal, or a combination of one or more of them.

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, or code) can be written in any form of programming language, including compiled or interpreted languages, or declarative or procedural languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, to name just a few.

Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse, a trackball or a musical instrument, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described is this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Particular embodiments of the subject matter described in this specification have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. A method comprising:

receiving a first user input entered on a user input device, the user input selecting a musical scale including receiving a user input selecting a key and a scale type, the musical scale being defined by multiple in-scale musical notes, the in-scale musical notes being a portion of a larger universe of musical notes;

receiving a second user input entering one or more musical notes from the universe of musical notes for recording on a recording medium;

determining whether each entered musical note is in the selected musical scale; and for each entered musical note that is in the selected musical scale, recording the entered musical note on the recording medium, and when the entered musical note is not in the selected musical scale, automatically replacing, using one or more computing devices, the entered musical note with a corrected musical note that is a nearest note in the selected musical scale and recording the corrected musical note on the recording medium.

2. The method of claim 1, wherein:

the larger universe of musical notes consists of musical notes separated by one or more semi-tones.

3. The method of claim 1, wherein the larger universe of musical notes comprises multiple octaves of the twelve notes of the Western musical scale.

4. The method of claim 1, wherein the larger universe of musical notes comprises multiple octaves of the five notes of a pentatonic musical scale.

5. The method of claim 1, wherein the larger universe of musical notes comprises notes separated by intervals smaller than a semitone.

6. A computer program product, encoded on a computer-readable storage device or substrate, operable to cause data processing apparatus to perform operations comprising:

receiving a first user input entered on a user input device, the user input selecting a musical scale including receiving a user input selecting a key and a scale type, the musical scale being defined by multiple in-scale musical notes, the in-scale musical notes being a portion of a larger universe of musical notes;

receiving a second user input entering one or more musical notes from the universe of musical notes for recording on a recording medium;

determining whether each entered musical note is in the selected musical scale; and for each entered musical note that is in the selected musical scale, recording the entered musical note on the recording medium, and when the entered musical note is not in the selected musical scale, automatically replacing the entered musical note with a corrected musical note that is a nearest note in the selected musical scale and recording the corrected musical note on the recording medium.

7. The product of claim 6, wherein:

the larger universe of musical notes consists of musical notes separated by one or more semi-tones.

8. The product of claim 6, wherein the larger universe of musical notes comprises multiple octaves of the twelve notes of the Western musical scale.

9. The product of claim 6, wherein the larger universe of musical notes comprises multiple octaves of the five notes of a pentatonic musical scale.

10. The product of claim 6, wherein the larger universe of musical notes comprises notes separated by intervals smaller than a semitone.

11. A system comprising:

a user input device; and one or more computers operable to interact with the user input device and operable to perform operations comprising:

receiving a first user input entered on the user input device, the user input selecting a musical scale including receiving a user input selecting a key and a scale type, the musical scale being defined by multiple in-scale musical notes, the in-scale musical notes being a portion of a larger universe of musical notes;

receiving a second user input entering one or more musical notes from the universe of musical notes for recording on a recording medium;

determining whether each entered musical note is in the selected musical scale; and for each entered musical note that is in the selected musical scale, recording the entered musical note on the recording medium, and when the entered musical note is not in the selected musical scale, automatically replacing the entered musical note with a corrected musical note that is a nearest note in the selected musical scale and recording the corrected musical note on the recording medium.

12. The system of claim 11, wherein:

the larger universe of musical notes consists of musical notes separated by one or more semi-tones.

13. The system of claim 11, wherein the larger universe of musical notes comprises multiple octaves of the twelve notes of the Western musical scale.

14. The system of claim 11, wherein the larger universe of musical notes comprises multiple octaves of the five notes of a pentatonic musical scale.

15. The system of claim 11, wherein the larger universe of musical notes comprises notes separated by intervals smaller than a semitone.

16. The system of claim 11, wherein the user input device is a MIDI keyboard.

17. The system of claim 11, wherein the recording medium is a digital memory.

18. The system of claim 11, further comprising:

a user display device operable to display entered and corrected musical notes graphically.

19. A method comprising:

displaying a graphic representation of a segment of music including a plurality of musical notes;

receiving a user input selecting:

a first musical scale and a different second musical scale, each musical scale being defined by multiple in-scale musical notes, the in-scale musical notes being a portion of a larger universe of musical notes, multiple musical notes from the displayed graphic representation, the multiple musical notes being associated with the first musical scale, and a pitch displacement, the pitch displacement including moving the selected multiple musical notes a user-selected interval amount independent of the interval amount between the first musical scale and the second musical scale, and replacing each selected musical note with a new musical note for the second musical scale;

determining whether each new musical note is in the second musical scale; and for each new musical note that is in the second musical scale, recording the new musical note on the recording medium, and when the new musical note is not in the second musical scale, automatically replacing, using one or more computing devices, the new musical note with a corrected musical note that is in the second musical scale and recording the corrected musical note on the recording medium.

20. The method of claim 19, wherein:

each change to the graphic representation of a musical note changes the corresponding musical audio data.

21. The method of claim 19, further comprising:

receiving user input selecting a pitch displacement for one or more corrected musical notes.

22. A computer program product, encoded on a computer-readable storage device or substrate, operable to cause data processing apparatus to perform operations comprising:

displaying a graphic representation of a segment of music including a plurality of musical notes;

receiving a user input selecting:

a first musical scale and a different second musical scale, each musical scale being defined by multiple in-scale musical notes, the in-scale musical notes being a portion of a larger universe of musical notes, multiple musical notes from the displayed graphic representation, the multiple musical notes being associated with the first musical scale, and a pitch displacement, the pitch displacement including moving the selected multiple musical notes a user-selected interval amount independent of the interval amount between the first musical scale and the second musical scale, and replacing each selected musical note with a new musical note for the second musical scale;

determining whether each new musical note is in the second musical scale; and for each new musical note that is in the second musical scale, recording the new musical note on the recording medium, and when the new musical note is not in the second musical scale, automatically replacing the new musical note with a corrected musical note that is in the second musical scale and recording the corrected musical note on the recording medium.

23. The product of claim 22, wherein:

each change to the graphic representation of a musical note changes the corresponding musical audio data.

24. The product of claim 22, the operations further comprising:

receiving user input selecting a pitch displacement for one or more corrected musical notes.

25. A system comprising:

a user interface device; and one or more computers operable to interact with the user interface device and operable to perform operations comprising:

displaying a graphic representation of a segment of music including a plurality of musical notes;

receiving a user input selecting:

a first musical scale and a different second musical scale, each musical scale being defined by multiple in-scale musical notes, the in-scale musical notes being a portion of a larger universe of musical notes, multiple musical notes from the displayed graphic representation, the multiple musical notes being associated with the first musical scale, and a pitch displacement, the pitch displacement including moving the selected multiple musical notes a user-selected interval amount independent of the interval amount between the first musical scale and the second musical scale, and replacing each selected musical note with a new musical note for the second musical scale;

determining whether each new musical note is in the second musical scale; and for each new musical note that is in the second musical scale, recording the new musical note on the recording medium, and when the new musical note is not in the second musical scale, automatically replacing the new musical note with a corrected musical note that is in the second musical scale and recording the corrected musical note on the recording medium.

26. The system of claim 25, wherein:

each change to the graphic representation of a musical note changes the corresponding musical audio data.

27. The system of claim 25, the operations further comprising:

receiving user input selecting a pitch displacement for one or more corrected musical notes.

* * * * *